US008632218B2

(12) United States Patent
Park et al.

(10) Patent No.: US 8,632,218 B2
(45) Date of Patent: Jan. 21, 2014

(54) LIGHTING DEVICE

(75) Inventors: Hun Yong Park, Gyunggi-do (KR); Byung Man Kim, Gyunggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 196 days.

(21) Appl. No.: 13/227,948

(22) Filed: Sep. 8, 2011

(65) Prior Publication Data

US 2012/0063143 A1 Mar. 15, 2012

(30) Foreign Application Priority Data

Sep. 9, 2010 (KR) ..... 10-2010-0088407

(51) Int. Cl.
*F21S 8/00* (2006.01)

(52) U.S. Cl.
USPC ..... 362/277; 362/289

(58) Field of Classification Search
USPC ..... 362/319, 311.01, 311.02, 289, 285, 277
See application file for complete search history.

(56) References Cited

U.S. PATENT DOCUMENTS 6,666,689 B1 * 12/2003 Savage, Jr. ..... 439/56
6,726,342 B1 * 4/2004 Lai ..... 362/188
7,349,163 B2 3/2008 Angelini et al.
8,292,470 B2 * 10/2012 Liao ..... 362/311.02
2008/0130137 A1 6/2008 Angelini et al.
2009/0052183 A1 * 2/2009 Li et al. ..... 362/282
2012/0081901 A1 * 4/2012 Tsang ..... 362/277
2012/0236564 A1 * 9/2012 Lee ..... 362/285

FOREIGN PATENT DOCUMENTS

JP 2009-043566 2/2009
KR 20-0356390 Y1 7/2004
KR 10-0636537 B1 10/2006
KR 20-2007-0000749 U 6/2007
KR 10-2009-0029056 A 3/2009

* cited by examiner

*Primary Examiner* — Julie Shallenberger
(74) *Attorney, Agent, or Firm* — McDermott Will & Emery LLP

(57) ABSTRACT

A lighting device is provided. The lighting device includes: a light source module mounted on a substrate; a lens unit provided on the light source module and including an accommodating groove accommodating the light source module; a housing unit accommodating the lens unit therein to protect the lens unit from an outside; a supporting unit fixed to the substrate and including a coupling hole having the housing unit coupled thereto to thereby support the housing unit; and a height adjustment unit allowing the housing unit to be vertically-movably coupled to the supporting unit and adjusting a height of the lens unit such that the height of the lens unit is varied.

11 Claims, 5 Drawing Sheets

LIGHTING DEVICE

CROSS-REFERENCE TO RELATED APPLICATIONS

This application claims the priority of Korean Patent Application No. 10-2010-0088407 filed on Sep. 9, 2010, in the Korean Intellectual Property Office, the disclosure of which is incorporated herein by reference.

BACKGROUND OF THE INVENTION

1. Field of the Invention

The present invention relates to a lighting device.

2. Description of the Related Art

In general, a light emitting device package, including a light emitting device emitting light according to an application of an electrical signal thereto, has been widely used in various electronic products and mobile communications terminals, such as personal cellular phones, personal digital assistants (PDAs) and the like.

Recently, with an increase in light emitting device efficiency, the range of applications of a light emitting device package has been extended, and a secondary lens has been required for various applications of a light emitting device package.

Here, the secondary lens refers to a lens formed such that light emitted from a light emitting device has a radiation angle corresponding to the usual purpose and application field thereof.

The secondary lens may be mounted on a substrate so as to accommodate the light emitting device and a primary lens therein. Methods or structures for mounting the secondary lens on the substrate may be variously designed.

In general, methods of mounting a secondary lens on a substrate according to the related art may include a method of attaching a secondary lens directly to a substrate and a method of using a separate pillar allowing for the fixation of the secondary lens. These methods may be referred to as a direct attachment method and a pillar structure attachment method.

The method of attaching a secondary lens directly to a substrate ("direct attachment method") may be more economically advantageous than a method of mounting a secondary lens on a substrate by using a separate device. However, the direct attachment method may be disadvantageous in that the function thereof capable of protecting the light emitting device package and the secondary lens from external circumstances is defective.

In addition, since the secondary lens needs to be attached directly to the substrate, an attachment area wider than a diameter of the lens may be required.

Moreover, the pillar structure attachment method is a method of fixing a secondary lens by using a separate pillar-shaped device, and may be disadvantageous, in that the arrangement and optical performance of lenses may have adverse effects due to the deformation of the pillar-shaped device (deformation in a pillar shape).

In addition, the pillar structure attachment method may require an attachment area wider than a diameter of the lens, similarly to the direct attachment method, and in the pillar structure attachment method, the precise arrangement of the light emitting device package may not be facilitated due to the injection molding of the pillar.

Thus, a technique of stably supporting a secondary lens while overcoming the above disadvantages is required.

SUMMARY OF THE INVENTION

An aspect of the present invention provides a lighting device capable of stably protecting a lens unit, that is, a secondary lens corresponding to an application field from external environments while having improvements in heat radiation efficiency.

According to an aspect of the present invention, there is provided a lighting device, comprising: a light source module mounted on a substrate; a lens unit provided on the light source module and including an accommodating groove accommodating the light source module; a housing unit accommodating the lens unit therein to protect the lens unit from an outside; a supporting unit fixed to the substrate and including a coupling hole having the housing unit coupled thereto to thereby support the housing unit; and a height adjustment unit allowing the housing unit to be vertically-movably coupled to the supporting unit and adjusting a height of the lens unit such that the height of the lens unit is varied.

The height adjustment unit may include a screw thread formed along an outer side of a bottom of the housing unit and a screw groove formed along an inner circumferential surface of the coupling hole of the supporting unit, corresponding to the screw thread.

The housing unit may include an upper open hole and a lower open hole in an upper portion and a lower portion thereof, respectively such that an upper surface and a lower surface of the lens unit are exposed to the outside, and may include a window in a side circumferential surface thereof such that a side surface of the lens unit is exposed to the outside.

The housing unit may include a seating unit protrudedly formed along an inner circumferential surface of the lower open hole thereof, such that a lower end surface of the lens unit including the accommodating groove may be seated on the seating unit.

The supporting unit may be provided with a screw groove for a screw connection with the substrate.

The screw groove may be formed in a position of the supporting unit, corresponding to a position of the window.

The supporting unit may include a protrusion inserted into the substrate.

The lens unit may include a coupling protrusion protrudedly formed in a position corresponding to the window, and the housing unit may include a coupling groove in the window thereof so as to catch and fix the coupling protrusion thereto.

The lighting device may further include a holder unit interposed between the housing unit and the lens unit.

The holder unit may include an upper open hole and a lower open hole exposing an upper surface and a lower surface of the lens unit to the outside, in an upper portion and a lower portion thereof, respectively, and include a window exposing the lens unit to the outside, in a side circumferential surface thereof.

BRIEF DESCRIPTION OF THE DRAWINGS

The above and other aspects, features and other advantages of the present invention will be more clearly understood from the following detailed description taken in conjunction with the accompanying drawings, in which.

The above and other aspects, features and other advantages of the present invention will be more clearly understood from the following detailed description taken in conjunction with the accompanying drawings, in which.

DETAILED DESCRIPTION OF THE INVENTION

Figure 1:
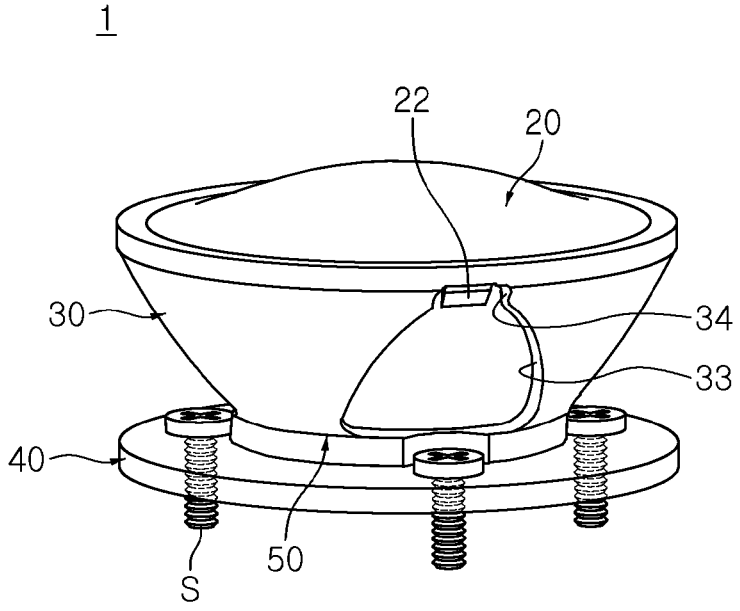
FIG. 1 is a schematic view of a lighting device according to an embodiment of the present invention.

Embodiments of the present invention will now be described in detail with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and sizes of components are exaggerated for clarity. The same or equivalent elements are referred to by the same reference numerals throughout the specification.

A lighting device according to an embodiment of the present invention will be explained with reference to FIGS. 1 through 6.

Figure 2:
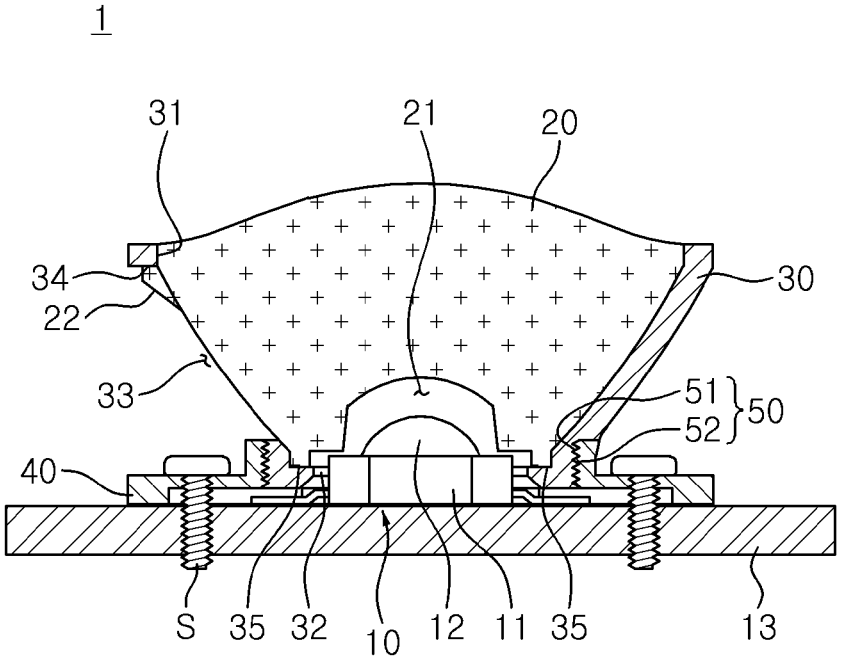
FIG. 2 is a schematic cross-sectional view of the lighting device shown in FIG. 1.

FIG. 1 is a schematic view of a lighting device according to an embodiment of the present invention. FIG. 2 is a schematic cross-sectional view of the lighting device shown in FIG. 1.

Figure 3:
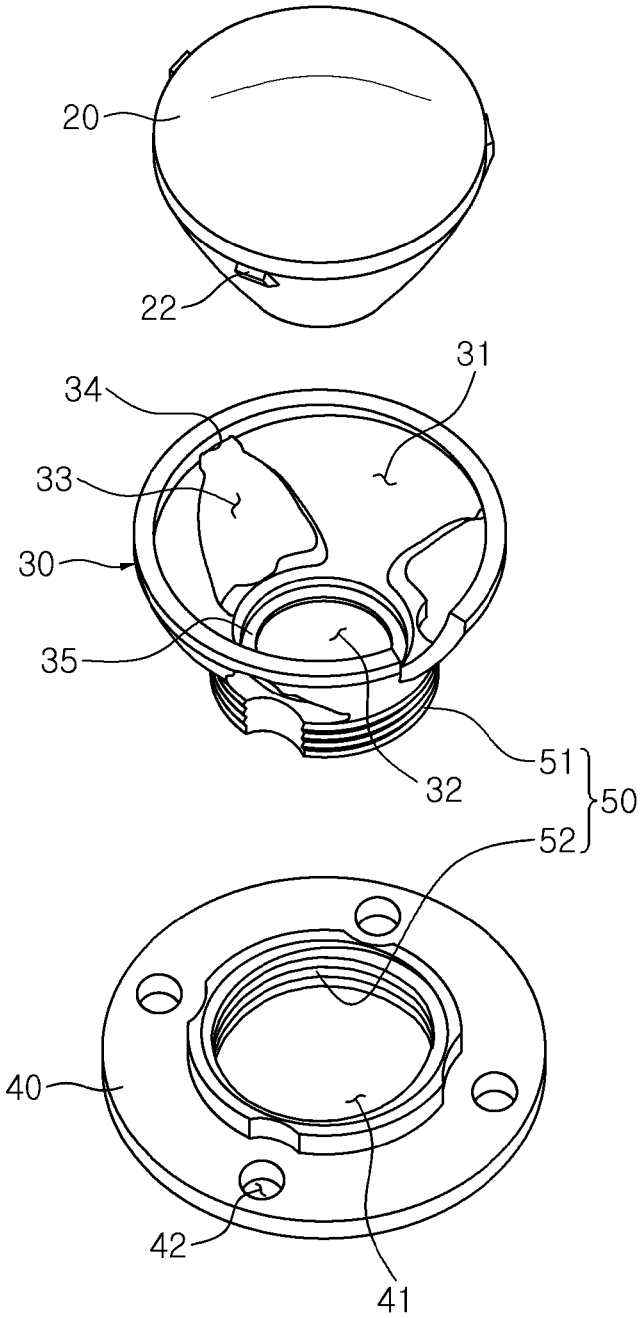
FIG. 3 is a schematic exploded perspective view of the lighting device shown in FIG. 1.
Figure 4:
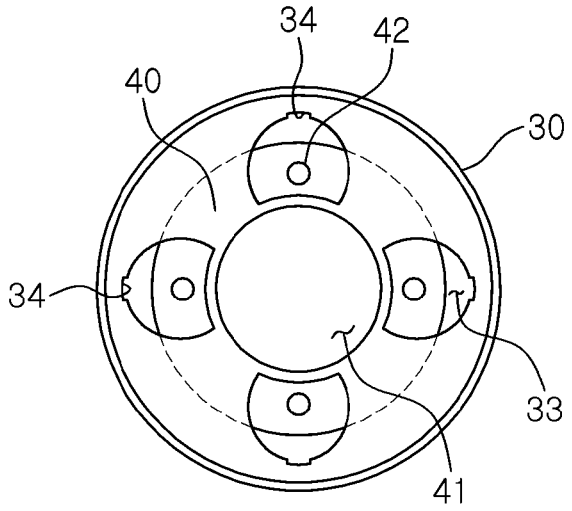
FIG. 4 is a schematic view of a housing unit in the lighting device shown in FIG. 1.
Figure 5:
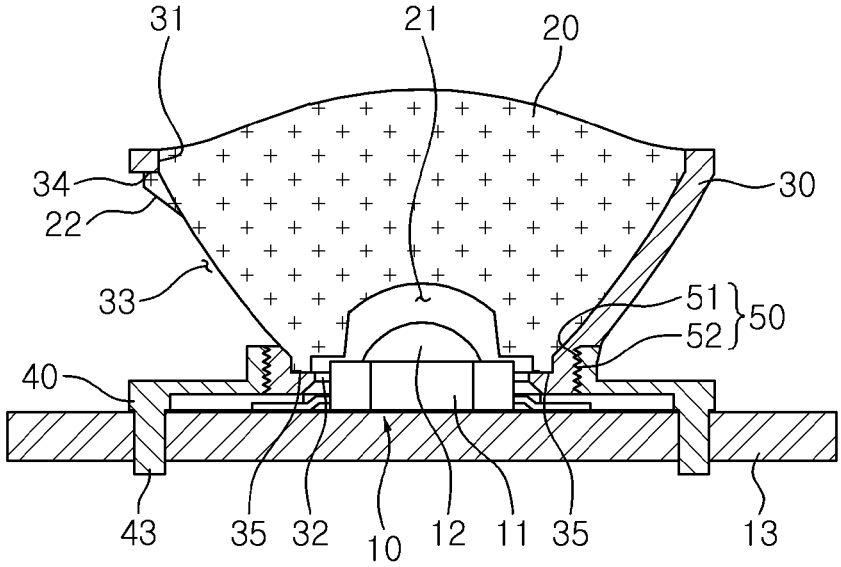
FIG. 5 is a schematic view of a modified example of a supporting unit in the lighting device shown in FIG. 2.
Figure 6A:
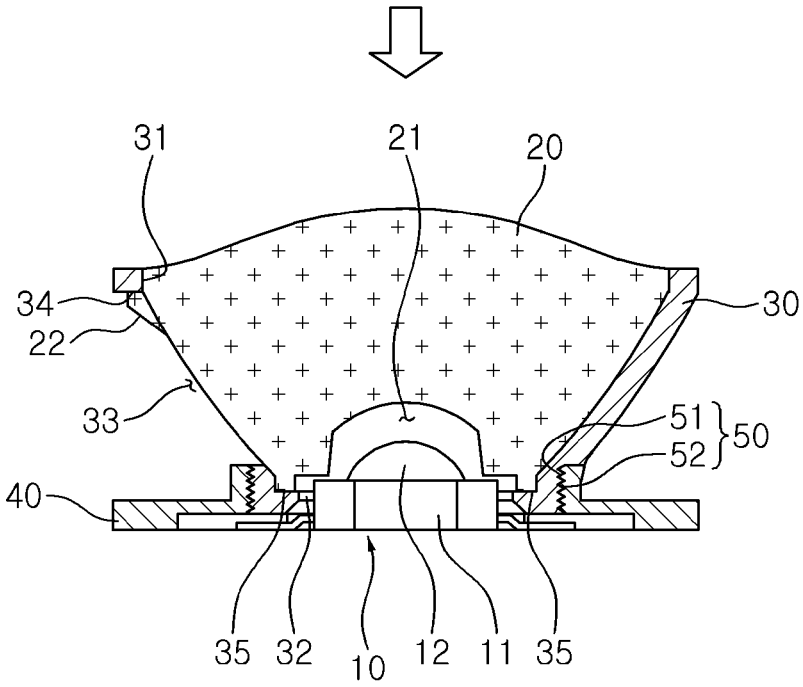
FIGS. 6A and 6B are schematic views explaining a height adjustment of the housing unit through a height adjustment unit in the lighting device shown in FIG. 2.
Figure 6B:
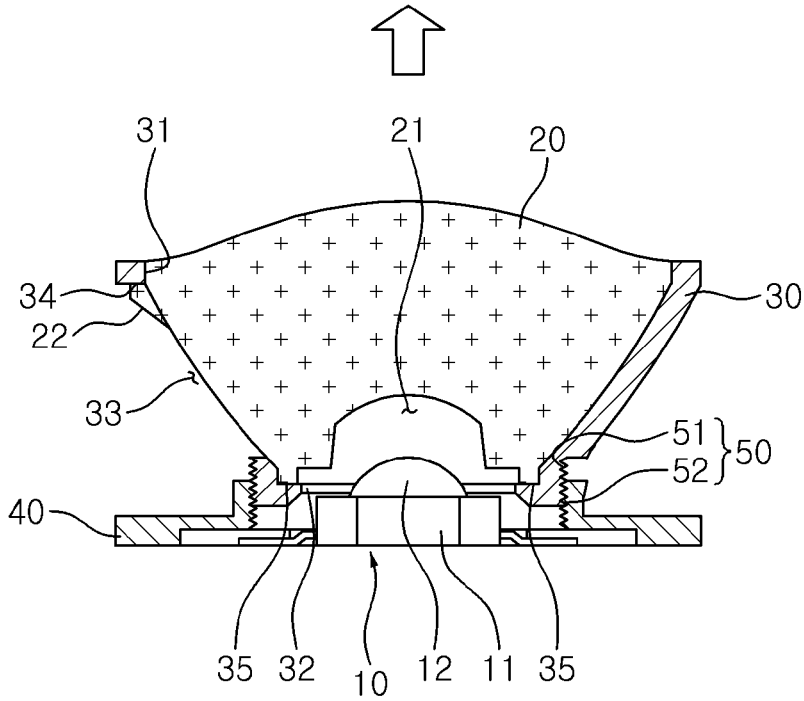

FIG. 3 is a schematic exploded perspective view of the lighting device shown in FIG. 1. FIG. 4 is a schematic view of a housing unit in the lighting device shown in FIG. 1. FIG. 5 is a schematic view of a modified example of a supporting unit in the lighting device shown in FIG. 2. FIGS. 6A and 6B are schematic views explaining a height adjustment of the housing unit through a height adjustment unit in the lighting device shown in FIG. 2.

Referring to FIGS. 1 through 6, a lighting device 1 according to the embodiment of the present invention includes a light source module 10, a lens unit, 20, a housing unit 30, a supporting unit 40, and a height adjustment unit 50, and may further include a holder unit 60 interposed between the housing unit 30 and the lens unit 20.

The light source module 10 may include at least one LED package 11 and may be mounted on a substrate 13 so as to be electrically connected thereto. In particular, the light source module 10 may use a light emitting diode (LED), a kind of photoelectric conversion semiconductor element emitting light having a predetermined wavelength, as a light source. The LED package 11 may include at least one LED (not shown) therein.

The LED may be sealed and protected by a sealing unit 12 having a dome-shaped lens structure. In FIGS. 1 through 6, the light source module 10 may be provided to have the LED package 11 according to the embodiment of the present invention. However, the provision of the light source module 10 is not limited thereto and the light source module 10 may be provided as a light emitting diode chip.

The substrate 13, a kind of printed circuit board (PCB) may be made of an organic resin material containing epoxy, triazine, silicon, polyimide or the like and other organic resin materials, or may be made of a ceramic material such as AlN, $Al_2O_3$ or the like or a metallic and metallic compound material. The substrate 13 may include a metal core printed circuit board (MCPCB), a metal PCB.

The lens unit 20, a secondary lens allowing light emitted from the light source module 10 to have a radiation angle corresponding to the usual purpose and field of application thereof, may be provided on the light source module 10 and may include an accommodating groove 21 accommodating the light source module 10 therein. Specifically, a lower surface of the lens unit 20 may be provided with the accommodating groove 21 having a predetermined size, recessed inwardly of the lens unit 20, and accommodating a part of the LED package 11 including the sealing unit 12 (or lens) of the light source module 10. Thus, the accommodating groove 21 may be formed to have a shape corresponding to that of the sealing unit 12 or may be formed to have a size larger than the sealing unit 12. An upper surface of the lens unit 20 may be formed such that a central portion thereof is protruded or may be formed to have Fresnel lens structure.

A coupling protrusion 22 may be protrudedly formed from a side circumferential surfaceof the lens unit 20. Thus, when the lens unit 20 is inserted and accommodated within the housing unit 30, the lens unit 20 is caught by, and fixed to the housing unit, through the coupling protrusion 22 and may not be easily detached therefrom.

The housing unit 30 may accommodate the lens unit 20 therein and protect the lens unit 20 from the external environment. As in the drawings, the housing unit 30 may have an inverted truncated cone shape corresponding to the shape of the lens unit 20. Thus, when the lens unit 20 is accommodated in an inner space of the housing unit 30, the side circumferential surface of the lens unit 20 and an inner side of the housing unit may be closely adhered to be coupled with each other.

The housing unit 30 may include an upper open hole 31 and a lower open hole 32 in an upper portion and a lower portion thereof, respectively, in such a manner that the upper surface and the lower surface of the lens unit are exposed to the outside. In addition, the side circumferential surface of the housing unit 30 may be provided with at least one window 33 such that the side of the lens unit 20 is exposed to the outside. The window 33 may be provided in plural along the side circumferential surface of the housing unit 30. Thus, the lens unit 20 heated due to heat generated from the light source module 10 may emit heat to the outside through the window 33, such that the lens unit 20 may be cooled in a natural cooling manner to thereby improve heat radiation efficiency.

The window 33 of the housing unit 30 provided in a position of the housing unit 30 corresponding to the coupling projection 22 of the lens unit 20 may include a coupling groove 34 so as to catch and fix the coupling projection 22 thereto. The coupling groove 34 may be provided in a top portion of the window 33, specifically, adjacently to the upper open hole 31. Thus, the lens unit 20 may be caught and fixed between the coupling projection 22 and the coupling groove 34 and thus, may not be easily separated from the housing unit 30.

Meanwhile, the housing unit 30 may include a seating unit 35 protrudedly formed along an inner circumferential surface of the lower open hole 32. Thus, when the lens unit 20 is accommodated within the housing unit 30, the lower surface of the lens unit 20 may be seated on the seating unit 35 to be stably supported.

The supporting unit 40 may be mounted on the substrate 13 to be fixed thereto and includes a coupling hole 41 in a central portion thereof, the coupling hole 41 having the housing unit 30 coupled therewith, to thereby support the housing unit 30 through the coupling with the housing unit 30. The supporting unit 40 may be fixed to the substrate 13 through a screw connection with the substrate 13, and thus be provided with a screw groove 42 for a screw connection. The screw groove 42 may be formed in a position of the supporting unit 40 corresponding to the window 33 of the housing unit 30, as in FIG. 4, and may allow for the facilitated operation of a screw connection through the window 33 when a screw s is connected thereto. In addition, as in FIG. 5, the supporting unit 40 may include a protrusion 43 protrudedly formed from a bottom surface thereof and fix the protrusion 43 to the substrate 13 while having the protrusion 43 inserted thereinto.

The height adjustment unit 50 may allow the housing unit 30 to be vertically-movably coupled to the supporting unit 40 and adjust a height of the lens unit 20 such that the height of the lens unit 20 may be varied. Specifically, the height adjustment unit 50 may include a screw thread 51 formed along an outer side of the bottom of the housing unit 30 and a screw groove 52 formed along an inner circumferential surface of the coupling groove 41 of the supporting unit 40, corresponding to the screw thread 51. Thus, as in FIGS. 6A and 6B, the housing unit 30 may be rotated with respect to the supporting unit 40 in a clockwise direction or a counter clockwise direction through the height adjustment unit 50, whereby such that the housing unit 30 may move upwardly or downwardly to thereby allow the height of the lens unit 20 to be adjusted. That is, according to the related art, the lens unit 20 is fixedly provided with respect to the light source module 10, such that light is irradiated only within an orientation angle range of the lens unit 20. However, the height of the lens unit 20 may be varied with respect to the light source module 10 as in the embodiment of the present invention, whereby an orientation angle of a lighting device may be variously adjusted. This may lead to an advantage of controlling light such that light is irradiated at a desired orientation angle according to the usual purpose of the lighting device.

Figure 7:
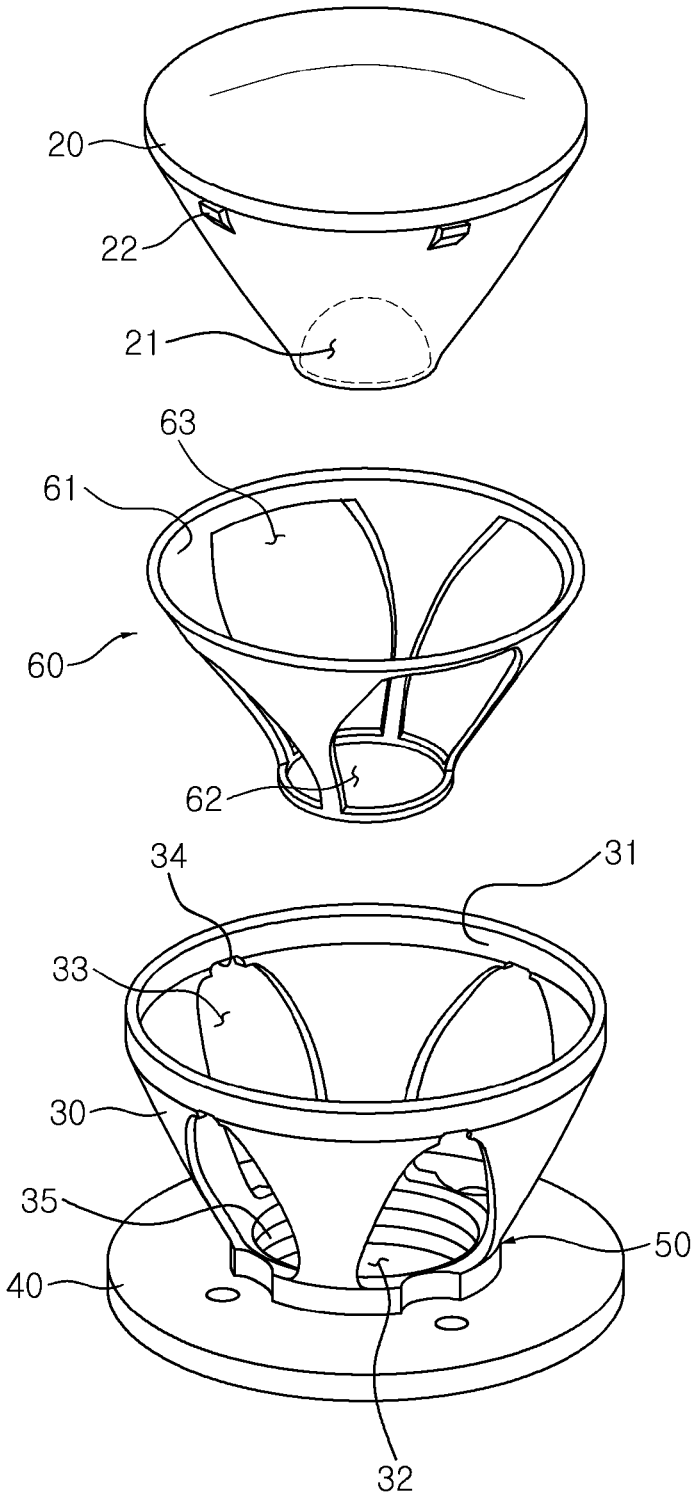
FIG. 7 is a schematic view of a lighting device according to another embodiment of the present invention.

FIG. 7 is a schematic view of a lighting device according to another embodiment of the present invention. Components configuring the lighting device in the embodiment shown in FIG. 7 are substantially the same as those in the case of the foregoing embodiment shown in FIGS. 1 through 6. However, since the embodiment shown in FIG. 7 is only different from the foregoing embodiment shown in FIGS. 1 through 6 in that it further includes the holder unit 60 as a component, and thus, a description regarding parts overlapping those of the foregoing embodiment will be omitted and a constitution regarding to the holder unit 60 may mainly be explained.

As in FIG. 7, the holder unit 60 may be interposed between the housing unit 30 and the lens unit 20. The lens unit 20 may be variously designed according to various required radiation angles, based on product requirements. The lens unit 20 manufactured to have various kinds of design may not be accommodated in the housing unit 30 according to the related art in such a manner as to closely adhered thereto. To this ends, the holder unit 60 performing a buffer function may be interposed between the lens unit 20 and the housing unit 30, an inner surface of the holder unit 60 is closely adhered to an outer surface of the lens unit 20, and an outer surface of the holder 60 is closely adhered to an inner surface of the housing unit 30. Thus, the holder unit 60 may be provided between the housing unit 30 and the lens unit 20 and substantially performs close adhesion of the lens unit 20 and the housing unit 30 to each other. In addition, only the holder unit 60 may be replaced without separately manufacturing the housing unit 30, according to the radiation angle of the lens unit 20, whereby economical effects may be obtained.

The holder unit 60 may include an upper open hole 60 and a lower open hole 60 exposing the upper surface and lower surface of the lens unit 20, in an upper portion and a lower portion thereof, respectively, similarly to the housing unit 30. In addition, the holder unit 60 may include a window 63 in a side circumferential surface thereof, the window 63 exposing the lens unit 20 to the outside. The window 63 included in the holder unit 60 may be formed in a position of the holder unit 60 corresponding the window 33 of housing unit 30, and may allow heat from the lens unit 20 to be easily emitted to the outside.

As set forth above, according to embodiments of the invention, a housing unit may include an accommodating space formed to have a shape corresponding to that of a lens unit to thereby entirely accommodate the lens unit therein, such that the lens unit and a light source module may be stably protected from external environments.

In addition, a window having an open shape may be provided in a side surface of the housing unit, such that thermal energy generated from the light source module may be easily emitted through the window.

In addition, the housing unit may not be fixed to a substrate and may be vertically-movably coupled thereto, such that a height of the lens unit may be varied to thereby adjust a radiation angle variance through the height adjustment of the lens unit.

While the present invention has been shown and described in connection with the embodiments, it will be apparent to those skilled in the art that modifications and variations can be made without departing from the spirit and scope of the invention as defined by the appended claims.

What is claimed is:

1. A lighting device, comprising:

a light source module mounted on a substrate;

a lens unit provided on the light source module and including an accommodating groove accommodating the light source module;

a housing accommodating the lens unit therein to protect the lens unit from an outside, the housing having a window on a side circumferential surface thereof such that a side surface of the lens unit is exposed to the outside;

a supporting unit fixed to the substrate and including a coupling hole having the housing coupled thereto to thereby support the housing unit; and a height adjustment unit allowing the housing to be vertically-movably coupled to the supporting unit and adjusting a height of the lens unit such that the height of the lens unit is varied.

2. The lighting device of claim 1, wherein the height adjustment unit includes a screw thread formed along an outer side of a bottom of the housing and a screw groove formed along an inner circumferential surface of the coupling hole of the supporting unit, corresponding to the screw thread.

3. The lighting device of claim 1, wherein the housing includes an upper open hole and a lower open hole in an upper portion and a lower portion thereof, respectively such that an upper surface and a lower surface of the lens unit are exposed to the outside.

4. The lighting device of claim 3, wherein the housing unit includes a seating unit protrudedly formed along an inner circumferential surface of the lower open hole thereof, such that a lower end surface of the lens unit including the accommodating groove is seated on the seating unit.

5. The lighting device of claim 3, wherein the supporting unit is provided with a screw groove fora screw connection with the substrate.

6. The lighting device of claim 5, wherein the screw groove is formed In a position of the supporting unit, corresponding to a position of the window.

7. The lighting device of claim 1, wherein the supporting unit includes a protrusion inserted into the substrate.

8. The lighting device of claim 3, wherein the lens unit includes a coupling protrusion protrudedly formed in a position corresponding to the window, and the housing includes a coupling groove in the window thereof so as to catch and fix the coupling protrusion thereto.

9. The lighting device of claim 1, further comprising a holder interposed between the housing unit and the lens unit.

10. The lighting device of claim 9, wherein the holder unit includes an upper open hole and a lower open hole exposing an upper surface and a lower surface of the lens unit to the outside, in an upper portion and a lower portion thereof, respectively, and includes a window exposing the lens unit to the outside, in a side circumferential surface thereof.

11. A lighting device, comprising:

a light source module mounted on a substrate;

a lens unit provided on the light source module and including an accommodating groove accommodating the light source module;

a housing accommodating the lens unit therein to protect the lens unit from an outside, the housing has a shape corresponding to that of the lens unit, such that the side circumferential surface of the lens unit and an inner side of the housing adhere to be coupled with each other when the lens unit is accommodated in an inner space of the housing;

a supporting unit fixed to the substrate and including a coupling hole having the housing coupled thereto to thereby support the housing; and a height adjustment unit allowing the housing to be vertically-movably coupled to the supporting unit and adjusting a height of the lens unit such that the height of the lens unit is varied.

* * * * *